United States Patent [19]

Wilson

[11] 4,208,030

[45] Jun. 17, 1980

[54] CONCRETE FORM TIE ROD AND FASTENER

[76] Inventor: Thomas W. Wilson, E. 35 Euclid Ave., Spokane, Wash. 99207

[21] Appl. No.: 915,820

[22] Filed: Jun. 15, 1978

[51] Int. Cl.[2] ..... E04G 17/08

[52] U.S. Cl. ..... 249/217; 249/40; 249/46; 249/190; 249/219 R

[58] Field of Search ..... 249/219 R, 46, 40, 216, 249/190, 217, 191

[56] References Cited

U.S. PATENT DOCUMENTS

| | | | |
|---|---|---|---|
| 1,293,391 | 2/1919 | Ewing | 249/217 |
| 1,912,356 | 6/1933 | Beghetti | 249/46 |
| 2,095,714 | 10/1937 | Pinaud et al. | 249/216 |
| 2,190,700 | 2/1940 | Colt | 249/219 |
| 3,327,988 | 6/1967 | Bridges | 249/213 |
| 3,417,958 | 12/1968 | Rugger | 249/40 |

*Primary Examiner*—Donald J. Arnold

[57] ABSTRACT

A headless form tie rod and associated fastener that contacts the form tie at two spaced points. The tie rod provides a cylindrical body with plural spaced areas protruding in one dimension and flattened in the other dimension. The principal fastening structure provides a wedge type device that releasably fastens the rod in a form structure at two spaced points. A species of fastener provides releasable fastening by means of a pivotable lever. Spacing washers releasably positionable on the form ties maintain forms in spaced relationship.

5 Claims, 14 Drawing Figures

FIG. 1
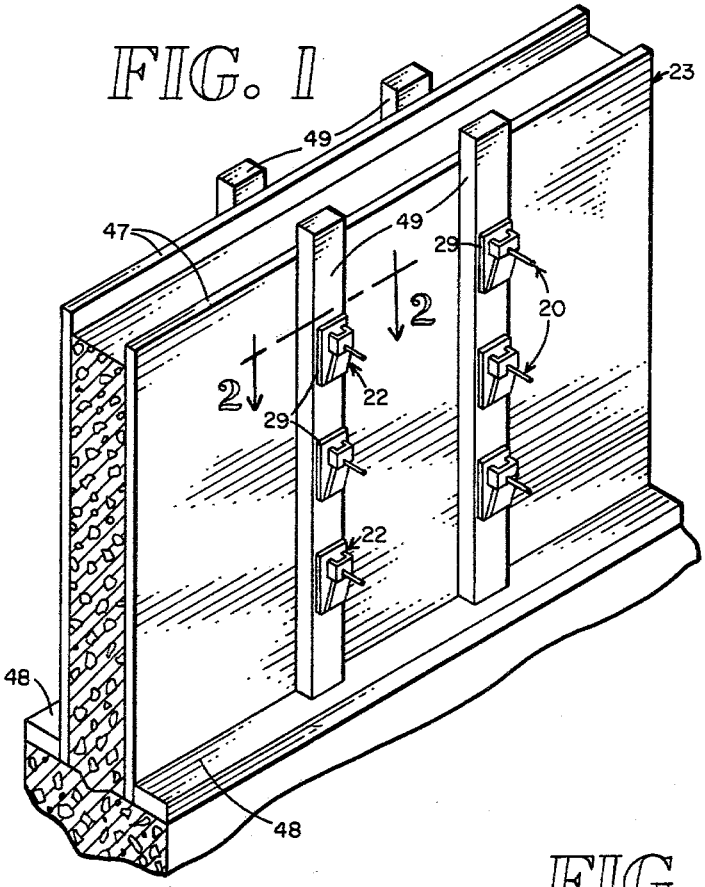
FIG. 9
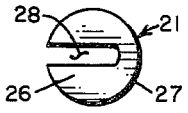
FIG. 8
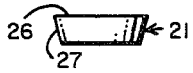
FIG. 2
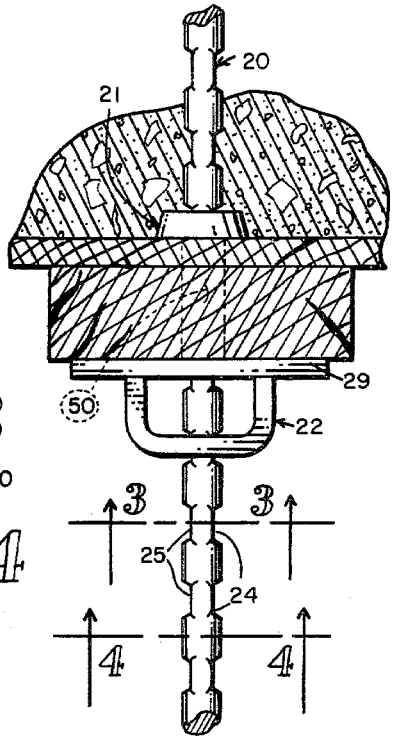
FIG. 3
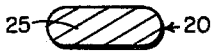
FIG. 4
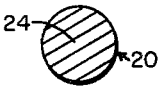
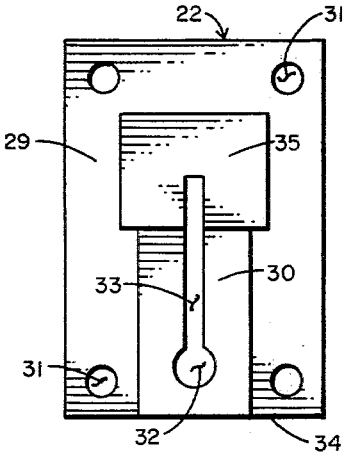
FIG. 6
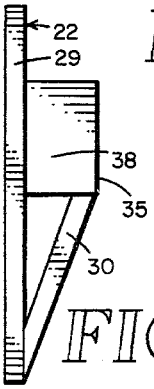
FIG. 7
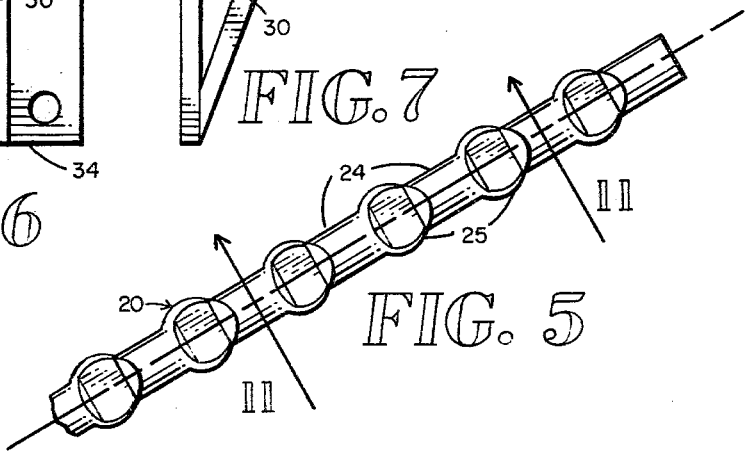
FIG. 5

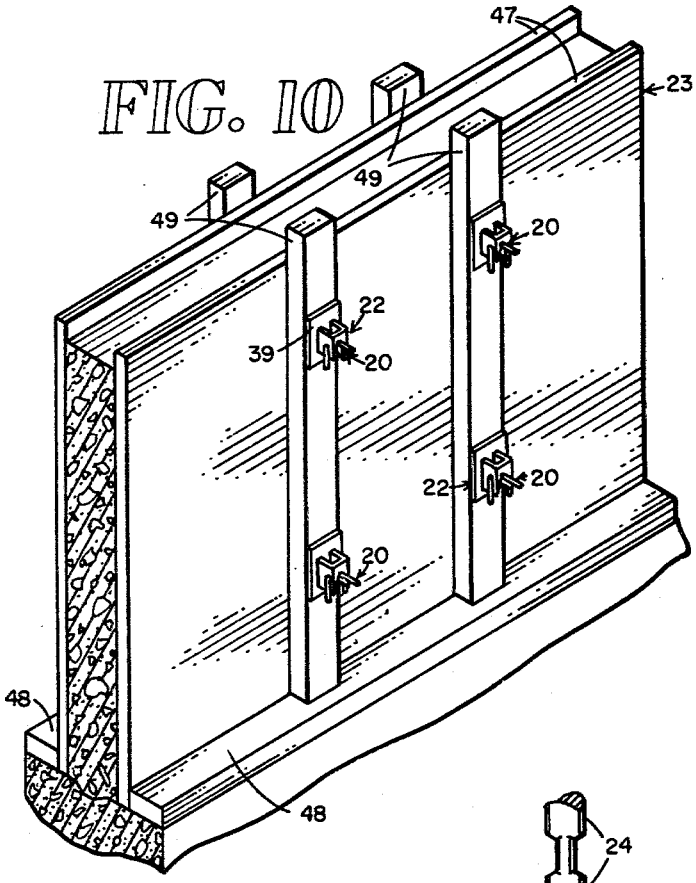
FIG. 10
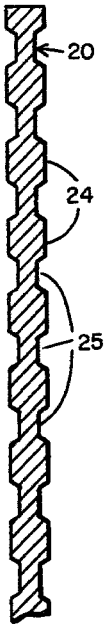
FIG. 11
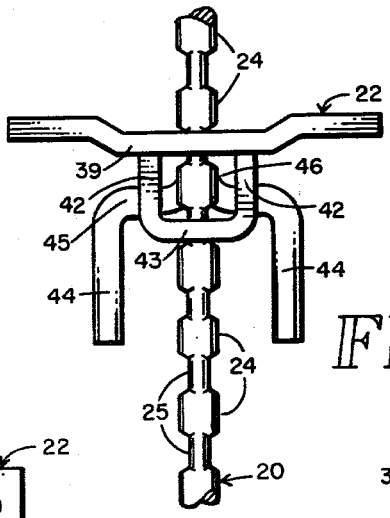
FIG. 12
FIG. 13
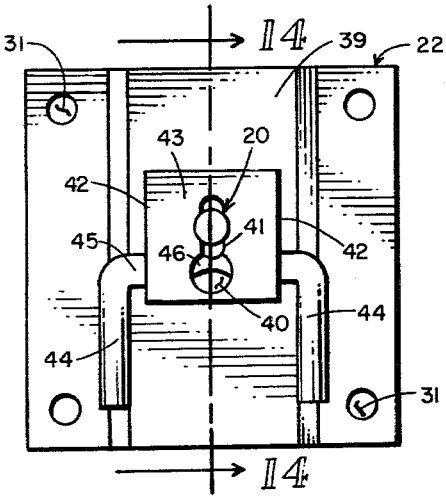
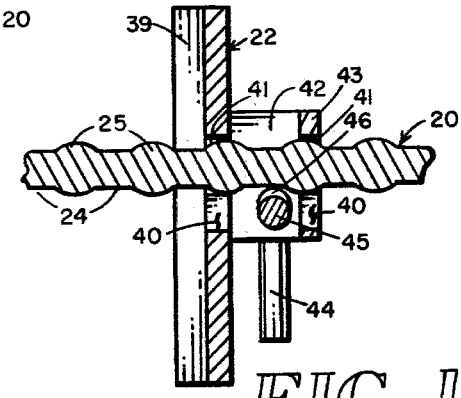
FIG. 14

CONCRETE FORM TIE ROD AND FASTENER

BACKGROUND OF INVENTION

1. Related Applications

There are no prior applications related hereto filed in this or any foreign country.

2. Field of Invention

My invention relates generally to form ties and tie fasteners for modular concrete forms and more particularly to headless ties and reusable fasteners supported on the ties at two spaced points.

3. Description of Prior Art

Modular reusable forming structures for concrete, especially for use with vertically oriented planar surfaces of some areal extent, have been found desirable in the modern day concrete forming arts. In response to this finding various types of such structures have become known. These known structures all generally provide some sort of larger surface forming element supported by an auxiliary external frame commonly providing vertical columnar elements or so-called 'studs' and horizontal beam elements or so-called 'whalers'. Initially the surface forming elements were substantially planar and commonly formed of wood, but they have become much more sophisticated and complex in the development of the art and now may be formed from metals, plastics or composite materials oftentimes to particular non-planar configuration and with special structural adaptations. Vertical supporting studs and horizontal beams in the inception were commonly wooden elements but they again have oftentimes devolved into metal or composite elements of one sort or another often of a complex configuration.

Common with these forming structures are wire-like tie rods that hold adjacent form elements together and at the same time maintain surface forming elements in a spaced relationship. In the earlier development of the concrete forming art this function was commonly accomplished with form wire and spacer blocks. These devices have given way to the typical head form tie of present day commerce which provides a rod-like structure sized to give some rigidity and having an end structure with a protuberance spacedly inward of the head to maintain a spacing washer on the inside of a surface forming element and a larger head at the end outside a form to engage some type of fastener. This type of headed tie obviously is limited in its use to a form structure having a particular thickness and since forms commonly do differ in thickness a plurality of groups of form ties of differing lengths may be required to form a single structure. Similarly with a headed form tie the holes carrying the ties must be large enough to allow for passage of the head and since the head of necessity must be larger diametrically than the body of the tie this always leaves holes in the form through which plastic concrete may ooze.

Various releasable fastening devices, and particularly those of the wedge-type as are commonly used with headed form ties, allow for some adjustment of effective fastening length of a tie used in a particular forming structure, but this adjustable feature is not great and not nearly sufficient to allow for all of the possible variations of length of ties that might be required, even in a single structure.

Responsive to this problem my invention provides a headless form tie of indefinite length, having cyclically similar spaced flattened protuberances defined from an initially cylindrical body and that may be cut to any desired length from elongate stock. The configuration defining the flattened protuberances provides a convenient method of severing pieces of form tie to desired lengths by bending or breaking. My tie rod is formed of mild steel material similar to that of the common headed tie rods of present day commerce and may be manufactured at a cost no greater than that of a similar headed tie rod.

My releasable fastener provides support at two spaced points on my tie rod to establish appropriate length and rigidity substantially equal to that of a headed toe rod of the same initial diameter. Various fastening devices have heretofore become known for non-headed tie rods, but these devices in general have not provided a structure so strong as that provided by my invention nor so strong as that of the typical headed form tie. Such prior fasteners for non-headed form ties have not gained ready industry acceptance because of this lack of strength.

My invention is distinguished from the prior art in providing a headless tie rod that may be formed to any desired length, from stock of indeterminate length, and used with pairs of particular releasable fasteners and spacing washers to positionally maintain two opposed cooperating form elements. My tie rod may be conveniently broken to desired length by reason of its somewhat grooved configuration but yet that configuration provides substantially the same tensile strength as the typical cylindrical headed tie rod of the same body diameter. The fastening devices are adjustably positionable along the tie rod and contact it at two spaced points to provide resistance to stress parallel to the rod equal to that of the typical headed form tie of the same initial size. My tie rod structure provides the same use and benefits as obtained from the headed variety of form tie and may generally be used in the same situations as that headed variety of tie. My tie and fastener combination per se is as economical of manufacture as the common headed tie and fasteners of present day commerce and in overall use is more economical than that present system chiefly because of the lower required inventory. My tie and fasteners are synergisticly related to each other in that their various particularized elements combine to provide a functioning unit of an improved nature but yet either element by itself without the other has little, if any, use.

SUMMARY OF INVENTION

My invention in general provides a headless tie rod releasably carrying two spaced washers inside and two releasable fasteners outside surface forming elements to be spacedly maintained in a unitized form structure.

My tie rod stock is an elongate element of indeterminate length having a cylindrical wire-like body with plural similar spaced protuberances formed in the body to provide flattened portions with dimension greater than the cylindrical body in one dimension and less than the body in a perpendicular dimension. The spaced washers are flat disc-like structures with a medial slot, adapted to nicely fit on the flattened part of a tie rod protuberance, communicating radially inwardly from the disc periphery. The principal form of fasteners of my invention provide a wedge formed of two angularly joined metal sheets having cooperating holes large enough to allow passage of the tie rod through each angled sheet; each such hole communicating with a smaller slot sized to allow a nice sliding fit over the flattened portion of a tie rod protuberance. The slots are oriented to extend away from the apex of the two elements forming the fastening wedge. The spacing between the two slots defined in the wedge element is equal to that between either one or a multiple of tie rod protuberances.

A species of my invention provides a form of tie rod fastener with a two spaced backing plate fastening hole and a pivotably associated lever to releasably fasten and maintain a tie rod therein. The plate has a key type hole of the same nature as that of the wedge type fastener. The fastener provides two parallel spaced elements each defining cooperating key type holes with slots to simultaneously receive spaced flattened portions of a tie rod. A bell crank type fastening lever is pivotably mounted at a spaced distance from the tie rod with a portion of the lever shaped to contact the tie rod between the key holes and upon appropriate pivotal motion to fasten against the tie rod to maintain it in the key holes.

In conceiving my invention it is:

A principal object to provide a tying structure for modular concrete forms to maintain the forms in spaced relationships, including a particular headless tie rod formed from stock of indeterminate length and particular fasteners releasably fastenable thereon.

A further object to provide such a tie rod that is formed with similar uniformly spaced flattened protuberances to allow fastening at plural points with my fasteners and also provide ready means for breaking or cutting tie rod stock to desired length.

A further object to provide a releasable fastener for use with my tie rod that fastens upon the tie rod at two spaced points to provide a communication between fastener and tie rod of great strength and durability that nearly approaches the tensile strength of the tie rod itself.

A still further object to provide a fastener that operates on the principle of a wedge to move relative to an associated tie rod to tighten against an adjacent forming member.

A still further object to provide a species of fastener that has spaced fastening elements and a spacedly associated bell crank that pivots to releasably fasten a tie rod and against the exterior of a form structure.

A still further object of my invention to provide such a fastening structure that is of new and novel design, of rugged and durable nature, of simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only preferred and practical embodiments being illustrated in the accompanying drawings, as is required.

BRIEF DESCRIPTION OF DRAWINGS

In the accompanying drawings which form a part hereof and wherein like numbers of reference refer to similar parts throughout:

FIG. 1 is an isometric view of a cut-away part of a typical modular concrete forming system using a form of my invention and having concrete in place therein.

FIG. 2 is a partially cut-away top view of a spacer washer and wedge-type fastener in place on a tie rod, taken on the line 2—2 of FIG. 1 in the direction indicated by the arrows thereon.

FIG. 3 is across-section through a protuberance of the tie rod of FIG. 2 taken on the line 3—3 thereon in the direction indicated by the arrows.

FIG. 4 is a cross-section through the body of the tie rod of FIG. 2, taken on the line 4—4 thereon in the direction indicated by the arrows.

FIG. 5 is an isometric view of a section of my tie rod stock showing particularly its form and cyclicly similar configuration.

FIG. 6 is an orthographic front view of the wedge-type fastener of my invention as shown in place in FIG. 2.

FIG. 7 is an orthographic side view of the wedge-type fastener of FIG. 6.

FIG. 8 is an orthographic side view of a spacing washer used in connection with my form tie.

FIG. 9 is an orthographic plan view of the same fastening washer as shown in FIG. 8.

FIG. 10 is a partial isometric view of a typical unitized concrete forming system showing the lever activated species of fastener of my invention in use.

FIG. 11 is an elongate cross-sectional view of a portion of my fastening rod taken on the line 11—11 of FIG. 5 in the direction indicated by the arrows thereon.

FIG. 12 shows an isometric front view of the lever activated species of my fastener illustrated in general in FIG. 10.

FIG. 13 shows an orthographic top view of the lever activated fastener of FIG. 12.

FIG. 14 is a vertical cross-sectional view of the fastener of FIG. 12 taken on the line 14—14 in the direction indicated by the arrows thereon.

DESCRIPTION OF THE PREFERRED EMBODIMENT

My invention generally provides headless form tie rod 20 that positionally maintains spaced modular form structures 23 between spacer washers 21 and releasable fasteners 22 carried by the tie rod.

Tie rod 20 is an elongate structure formed from stock of indeterminate length and illustrated particularly in the drawings of FIGS. 5 and 11. The structure is formed with uniformly spaced alternating cylindrical body portions 24 and thinner fastening portions 25 that in one dimension extend readily outward from the periphery of the cylindrical portions and in the perpendicular dimension are somewhat thinner than in the body portion. The thinner fastening portions must be sufficiently thinner than the adjacent body portions to allow fastening of the tie rod in key hole slots as hereafter specified. The projection of the protuberances on the other hand must not be any greater than necessary so as to allow use of minimum sized holes for elongate passage of the rods.

The tie rods are preferably formed of metal wire of substantially the same type mild steel from which headed tie rods are presently formed. Protuberances may be conveniently formed in this wire stock by compressing portions of the wire with sufficient pressure between appropriately configured anvils. This type of compressive formation causes a thinning of the rod structure in a plane perpendicular to that of the protuberance but yet causes a protuberance projecting on both sides of the wire body in a substantially symmetrical fashion with a cross-sectional area substantially the same as that of the body wire. Preferably the tie rod stock is formed with similar equally spaced protuberances with the body portion beween protuberances approximately the same length as each protuberance section and with each repeating similar unit having a cyclic spacing of approximately one-half inch. Obviously, however, various spacings and even various arrangements of protuberances might be made in form ties other than that specified, without departing from the principles of my invention.

Since the form tie wire has a substantially equal cross-sectional area throughout its length, even though that area may be represented by different cross-sectional configuration, it has a substantially uniform tensile strength over that length. My tie rod may, however, be quite conveniently broken for flatter protuberance sections by bending it repeatedly in a plane substantially normal to the flat surface. The shape of the tie rod therefore allows a convenient method of breaking stock to desired lengths by manual manipulation without the necessary use of tools.

Spacer washers 21 are small, disc-like structures formed by body 26 defining outer peripheral surface 27 and tie rod notch 28. The washer body is somewhat larger than the largest diameter dimension of the tie rod so that it may fasten the tie rod against a form structure and not pass through the tie rod hole in such structure. Exact size of the washer is not critical but there is little reason to make it much larger than required for this function. Commonly the peripheral surface 27 is angled to the peripheral area surface of the washer, so that the structure constitutes a rather flat, truncated cone to allow its easy removal from formed concrete surfaces. The tie rod notch or groove extends, parallel to a radius of the washer, from its edge, through the center and some distance therepast. The groove is sized with a dimension very slightly greater than the thickness or lesser dimension of the protuberance portion of my tie rod, to provide a easy slip fit thereover, but smaller than the diameter of the cylindrical or body portion of the tie rod so that the washer will not pass over that body portion but rather be fastened thereagainst. Spacer washers of this type are not new and are presently known and used in the cement forming arts for purposes similar to that of my invention. Commonly these structures are formed of some rigid, reasonably durable plastic material but they very well may be formed of almost any rigid material having appropriate strength.

The principal wedge form of my tie rod fastener is shown particularly in FIGS. 6 and 7 where it is seen to comprise base plate 29 structurally carrying wedge shaped element 30 angularly projecting away from one surface. The base plate is a flat planar element of some areal extent defining plural fastening holes 31 preferably immediately inwardly adjacent its periphery. A keyhole slot comprises larger, circular hole portion 32 communicating with narrower slot portion 33 is defined in the lower part of the base plate inwardly adjacent lower edge 34 with the slot portion extending vertically away from that lower edge some substantial distance.

Wedge element 30 structurally communicates with lower edge 34 of the base plate and extends upwardly and outwardly therefrom at a shallow, included angle of approximately 20 degrees. Uppermost portion 35 of the wedge element commonly, though not necessarily, is turned inwardly parallel to the base plate. The sizing of this structure should be such that the distance from the inner side of the base plate (that opposite the wedge) to the outer side of upper part 35 of the wedge element is substantially the same as the spacing of one or a multiple of the cyclic units of the tie rod so that the wedge may have two point support upon the tie rod. This dimension obviously may be greater but not less than specified. A keyhole slot similar to that defined in the base plate is defined in wedge element 30 and positioned to cooperate with the base plate keyhole to allow passage and fastening of a tie rod therebetween. This keyhole slot again provides larger hole portion 32, defined in the wedge element immediately inwardly of its communication with lower edge 34 of the base plate, communicating with smaller slot portion 33 extending vertically upwardly therefrom. The sizing of this keyhole slot is substantially identical to that of the cooperating slot defined in the base plate. Commonly webs or supports 38 extend between the wedge element and base plate to provide additional rigidity for the structure though obviously these webs are not necessary if appropriate rigidity be otherwise provided.

The wedge fastener is preferably formed from sheet metal, such as mild to medium hard steel, that will provide appropriate durability but yet not splinter when struck by a hammer as in placement. Other sufficiently rigid materials might be used for the structure such as some types of plastic, aluminum and other metals, but none have proven so effective as mild steel when the cost of the structures be related to durability and useful life.

A secondary species of fastening device appears especially in the illustrations of FIGS. 12, 13 and 14. Here base plate 39 takes the form of a shallow channel element to provide somewhat more stiffness against vertical bending movements. The base plate, again preferably, defines plural fastening holes 31 inwardly of its periphery and defines in its medial part the keyhole slot having larger hole 40 communicating with smaller slot 41 again sized so that the hole allows elongate passage of a tie rod and the slot provides a nice sliding fit upon the thinner dimension of the protuberance portion of my tie rod but will not allow passage of the body portion. Channel element 42, 43 is structurally carried by the medial portion of the base plate, over the keyhole, by structural attachment of its similar opposed legs 42 therewith. The channel element has some projection outwardly from the base plate so that its body portion 43 is at a spaced distance therefrom. The portion of body 43 perpendicularly outwardly of keyhole 40, 41 defined in the body plate defines a similar keyhole to cooperate with that defined in the body to allow passage and fastening of the tie rod 20. The fastening lever is pivotable from the fastening position shown in FIGS. 12 and 13 to the perpendicularly non-fastening position shown in FIG. 13.

Channel element legs 42 cooperate to pivotably mount the "U" shaped fastening lever having similar opposed legs 44 interconnected by perpendicularly extending body 45. The medial portion of body 45 is formed with fastening protuberance 46 extending outwardly from the main body portion in a direction opposite to but in the plane of the legs 44.

The dimensioning and configuration of the secondary species of fastener is again critical as it also must provide two point support on a tie rod to be most effective and efficient and provide maximum strength. The dimensioning of the fastener must be such that when the tie rod is in a position as illustrated in FIGS. 12, 13 and 14, with the flat portion of a protuberance section carried in the narrower slot of the base plate 12. The flattened portion of another protuberance will be carried in the slot defined in body 43 of the channel element. At the same time the fastener lever must be rotatable into the fastening position illustrated in FIG. 13 with fastening protuberance 46 in contact with the undersurface of the tie rod to maintain it in fastened position in slots 41. This requires that the distance between the inner surface of the base plate immediately adjacent keyhole 40, 41 must be at a distance from the outwardly facing surface of body 43 of the channel element equal to one or a multiple of cyclic unit spacings on the tie rod. Most commonly because of practical size requirements this will be one or two cycles in distance.

From the foregoing description of my invention its use may be readily understood.

A typical form structure 23 is shown in general in the isometric illustrations of FIGS. 1 and 10 where it is seen to comprise planar forming elements 47 structurally maintained and supported by horizontal walers 48 and vertical studs 49. All of these elements, where necessary, define plural tie rod holes 50 to cooperatively allow the passage of form ties through the structure to maintain it together and in appropriate spaced relationship. Commonly cooperating sets of form tie holes will extend between the opposed, cooperating studs at various spaced vertical positions and in large structures they may also be provided in similar fashion between walers and between forming elements. This unitized forming structure is common in present day concrete forming arts and it is the structure with which my invention is designed to most efficiently operate.

To use my invention with such form structure, the form structure is initially positionally established as illustrated in FIG. 1. Plural tie rods 20 are then formed to appropriate length from bulk stock so that they may project through cooperating sets of holes between opposed form members and extend some distance therebeyond with a few cycles of protuberances exposed beyond the external form surface. Tie rods conveniently may be manually formed to length by repeatedly bending the rod at an appropriate protuberance until it breaks or the stock may be cut by various of the tools now used for cutting tie rods. The tie rod is then positioned in opposed cooperating sets of holes defined in opposed forming elements.

Two spacer washers are placed on each form tie rod between the two opposed planar forming elements at such spaced distance as desired for the ultimate wall thickness. These washers then, being on the inside of the forming elements, will maintain those forming elements at the spaced distance relative each other. Fasteners are then placed on each of the end portions of the tie rods outwardly of the form structure.

To place the principal wedge form of fastener, the fastener is inserted over the outwardly projecting end of the tie rod and commonly, though not necessarily, oriented with the narrowest part of the wedge projecting downwardly. The fastener is then positioned on the tie rod so that the keyhole defined in the base plate fits upon the protuberance sections of the tie rod that is nearest the outer surface of the form structure supporting the tie rod. The wedge is then moved relative to the tie rod so that the keyhole defined in wedge element 30 contacts an adjacent tie rod protuberance. The downward motion is continued until the wedge elements tighten against the inwardly adjacent form structure. If desired, the tightening action may be accentuated by moving the wedge by appropriate physical force such as the flow of a hammer. Normally if the wedge is established with some force it will maintain its position by reason of its frictional engagement with the tie rod and form structure without any further fastening, but again, if desired the wedge may be fastened in position by inserting nails through one or more of the plural fastening holes 31 and into the form structure. Another wedge is then fastened on the opposite end of the same tie rod in a similar fashion to complete the fastening unit.

To fasten a tie rod with the lever activated species of my invention, the fastener is placed over a tie rod positioned as before indicated and again the keyhole defined in the base plate of the fastener is engaged on the protuberance section most immediately outwardly adjacent the form element carrying the tie rod. The fastener is appropriately moved so that this protuberance becomes engaged in slot 41 of the keyhole defined in the fastening plate while the fastening lever is in disengaged position. This will also position an adjacent protuberance section of the tie rod in the keyhole slot defined in the channel body 38. Fastening lever 44, 45 is then pivotably moved so that fastening protuberance 46 becomes engaged with the immediately inwardly adjacent tie rod in question to maintain the protuberance sections in the keyhole slots all to provide a two point fastening communication with the tie rod. Again, the tightening operation may be accentuated by additional physical force commonly provided by a hammer blow on the fastening lever if necessary. Again, if desired, the fastener may be positionally maintained relative to the form structure by establishing one or more nails projecting through fastening holes 31 defined in the base plate 39 and into the adjacent forming structure.

Either of the fastening structures species may be released when desired by reversing the fastening process.

It is to be noted that either species of the fastening device of my invention may be reused at any time. It is especially to be noted in this regard that because of the curvilinear nature of the structures that come into fastening contact with each other there may be some degree of wear of either or both structures before that wear seriously effects the fastening operation of the parts.

It is further to be noted that in each of the species of fastening device of my invention there is a two point supportative or fastening contact between the fastening device and associated tie rod. It has been found from experimentation that such a two point contact is necessary for maximum strength of the joinder of fastener to tie rod and if there be only a single point contact between these members the joinder is only about half as strong as with the two point fastening. This two point fastening provides a total structure that has substantially the same strength as that obtained with a similarly sized headed tie rod of present day commerce.

The foregoing description of my invention necessarily is of a detailed nature so that a specific embodiment of it might be set forth as required, but it is to be understood that various modifications of detail, rearrangement and multiplication of parts may be resorted to without departing from its spirit, essence or scope.

Having thusly described my invention, what I desire to protect by Letters Patent, and What I claim is:

1. A headless concrete form tie rod and reusable fastener structure comprising, in combination:

a lineally elongate tie rod formed by plural spaced alternating similar cylindrical body portions and protuberances, each with an extension less than the body portion in one dimension and greater than the body portion in a substantially perpendicular dimension, all body portions and protuberances having substantially the same cross-sectional area; and a fastener structure contacting the tie rod at two spaced points, each of which carries part of a force parallel to the tie rod and fastener comprising first fastening means comprising a base plate defining a medial keyhole slot with a larger hole to permit elongate passage of a tie rod therethrough and a smaller slot extending from the larger hole to nicely fit over the narrower dimension of the protuberance portions but not allow passage of the adjacent cylindrical body portions of the rod therethrough; and second fastening means structurally carried by the base plate to come into fastening engagement with a protuberance of the tie rod at a spaced distance from the tie rod protuberance carried in the keyhole slot defined in the base plate.

2. The invention of claim 1 further characterized by the second fastening means, comprising:

a keyhole having a larger hole to prevent elongate passage of a tie rod therethrough with a narrower slot extending therefrom to nicely fit over the narrower dimension of a tie rod protuberance, defined in a wedge plate structurally communicating with the base plate and extending at an angle away therefrom, said keyhole positioned to cooperate with the keyhole defined in the base plate to simultaneously fastenably receive two spaced protuberance portions of the same tie rod.

3. The invention of claim 1 further characterized by the second fastening means comprising:

a keyhole having a larger hole to permit elongate passage of a tie rod therethrough with a narrower slot extending therefrom to nicely fit over the narrower dimension of a tie rod protuberance defined in the body of a channel element structurally carried by the base plate at a spaced distance therefrom, said keyhole positioned to cooperate with the keyhole defined in the base plate to simultaneously fastenably receive two spaced protuberance portions of the same tie rod.

4. A fastening system, for a concrete form structure having spaced forming elements, including a headless tie rod and two releasable fasteners comprising, in combination:

a lineally elongate tie rod formed by similar spaced alternating cylindrical body portions and protuberances portions, each protuberance portion having an extension in a first dimension greater than the adjacent body portions and an extension in a second substantially perpendicular dimension less than the adjacent body portions, all body portions and protuberances having substantially the same cross-sectional area; and the releasable fasteners each having a planar base plate with a structurally communicating wedge type element extending from one edge thereof angularly away therefrom, each element defining cooperating keyhole slots with a larger hole to permit the elongate passage of the tie rod therethrough and a smaller slot extending from the larger hole substantially parallel to the line of gradient of the wedge, said slot sized to nicely fit over the smaller dimension of the protuberance portion of a tie rod but not permit the passage of the body portions of the tie rod therethrough, the wedge being of dimension to allow fastening contact at two spaced points along a tie rod with at least one tie rod body portion between the base plate and the wedge element, so that each contact point between tie rod and fastener carries part of a force parallel to the tie rod existing between the elements.

5. A fastening system, for a concrete form structure having spaced forming elements, including a headless tie rod and two releasable fasteners comprising, in combination:

a lineally elongate tie rod formed by similar spaced alternating cylindrical body portions and protuberance portions, each protuberance portion having an extension in a first dimension greater than the adjacent body portion and an extension in a second substantially perpendicular dimension less than the adjacent body portions, all body portions and protuberances having substantially the same cross-sectional area; and a releasable fastening element having a rigid base plate defining a medial keyhole with larger circular hole, to allow elongate passage of a tie rod therethrough, communicating with a narrower slot extending therefrom and sized to nicely fit over the smaller dimension of a tie rod protuberance but not permit passage of a tie rod body section therethrough with a "U" shaped channel element structurally communicating with the base having a body at a spaced distance from the base, said channel body defining a keyhole having a larger hole to permit elongate passage of the tie rod therethrough and a narrower slot extending therefrom to nicely fit over the narrower dimension of a tie rod protuberance, said keyhole positioned to cooperate with the keyhole defined in the base to simultaneously fastenably receive two spaced protuberance portions of the same tie rod to distribute part of a force parallel to the tie rod between the rod and fastener at each of the fastening points; and "U" shaped fastening lever pivotably carried by the opposed legs of the channel element to come into releasable contact with a tie rod positioned in the keyhole slots of the base and channel elements when the fastening lever is pivoted to a fastening position to fastenably maintain the tie rod in the fastening element.

* * * * *